United States Patent [19]

Jones

[11] 3,978,901

[45] Sept. 7, 1976

[54] ELASTIC STORAGE TANK

[76] Inventor: Walter C. Jones, P.O. Box 398, Armstrong, Iowa 50514

[22] Filed: June 20, 1975

[21] Appl. No.: 588,905

[52] U.S. Cl. ..... 150/.5
[51] Int. Cl.[2] ..... B65D 33/16
[58] Field of Search ..... 150/.5, 1

[56] References Cited

UNITED STATES PATENTS

| | | | |
|---|---|---|---|
| 2,724,418 | 11/1955 | Krupp | 150/.5 |
| 3,919,030 | 11/1975 | Jones | 150/.5 X |

*Primary Examiner*—Donald F. Norton
*Attorney, Agent, or Firm*—Williamson, Bains & Moore

[57] ABSTRACT

An elastic, fluid-impervious storage tank includes an outer tank member which is comprised of a pair of end tank sections and an intermediate tank section, the latter being provided with an inlet or filler pipe. Each end section is formed from a single blank of fiber-reinforced elastomer which is cut and folded so that the corner portions thereof are of rounded configuration. A flexible envelope formed of a film of chemical inert fluid-impervious plastic material is positioned interiorly of the outer tank member. The film envelope is slightly larger than the outer tank member and is folded with accordian pleats when it is inserted into the outer tank member so that it first unfolds transversely and then longitudinally as it is filled with a liquid.

4 Claims, 4 Drawing Figures

ELASTIC STORAGE TANK

SUMMARY OF THE INVENTION

This invention relates to an elastic storage tank and method of assembling the same.

A general object of this invention is to provide an elastic storage tank, including an outer tank member of generally rectangular configuration when in the non-distended condition, but having arcuate corner portions. The tank includes a flexible envelope formed of a film of chemically inert fluid-impervious plastic material which is slightly larger in size than the outer tank member. The film envelope is slightly larger than the outer tank member and is folded with accordian pleats when it is inserted into the outer tank member so that it first unfolds transversely and then longitudinally as it is filled with a fluid.

Since the envelope is formed of a chemically inert plastic material, such as polyamide, the storage tank may be used to store corrosive materials such as herbicides, insecticides and the like. The envelope serves as an extremely efficient chemical barrier and because of its inexpensive construction, it may be discarded from the tank which is used to store a toxic fluid such as a herbicide or insecticide. Alternatively, the envelope may be removed and may be readily cleaned for reuse if desired. By using a removable chemical barrier type envelope, the storage tank not only may be used to contain corrosive materials, but the use of the envelope obviates the need to scrub or wash the interior of the elastomer outer tank member. Thus the tank may also be used to contain fluids such as milk and other liquid foods since the envelope is formed of a material having FDA approval for use in packaging or containing food materials.

These and other objects and advantages of this invention will more fully appear from the following description made in connection with the accompanying drawings, wherein like reference characters refer to the same or similar parts throughout the several views.

FIGURES OF THE DRAWINGS

DESCRIPTION OF THE PREFERRED EMBODIMENTS OF THE INVENTION

Figures 1, 2, 3, 4:
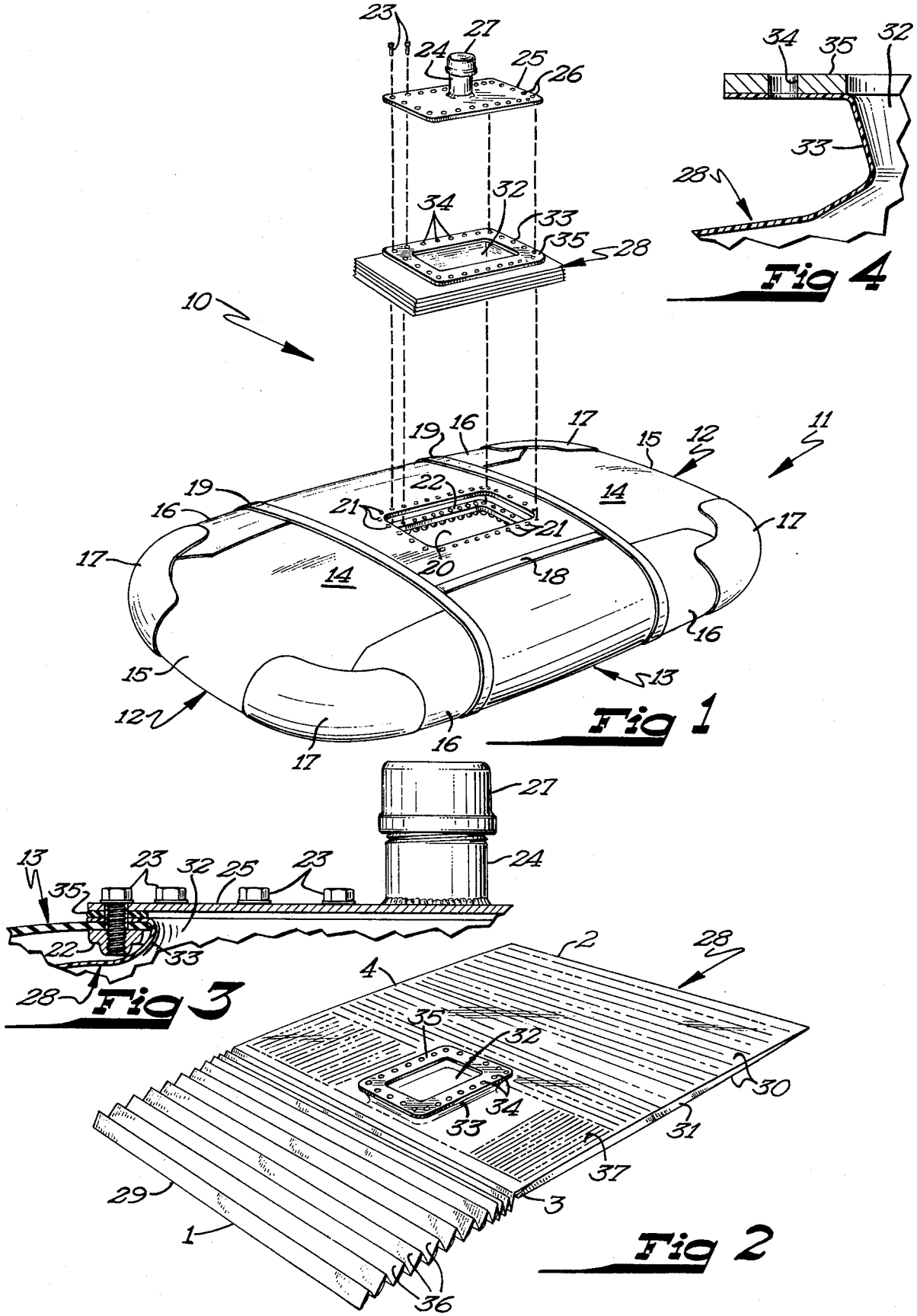
FIG. 1 is an exploded perspective view of the novel tank.
FIG. 2 is a perspective view of the envelope in a partially folded condition.
FIG. 3 is a fragmentary cross-sectional view illustrating the manner in which the envelope is secured to the outer tank member and the filler pipe.
FIG. 4 is a fragmentary cross-sectional view of a portion of the envelope illustrating the details of construction thereof.

Referring now to the drawings, and more specifically to FIG. 1, it will be seen that one embodiment of my novel flexible tank, designated generally by the reference numeral 10 is there shown. The tank 10 is comprised of an outer tank member 11 which includes a pair of end tank sections 12 and an intermediate tank section 13. The intermediate tank section 13 and each of the end tank sections 12 are constructed separately and are then joined together to form the complete outer tank section 11 which as shown, is of generally rectangular or parellelepiped configuration, but having rounded corner portions.

Each end tank section 12 is comprised of upper and lower wall portions 14 opposed side wall portions 16 and an end wall portion 15. Each end tank section 12 is formed from a single blank of fiber-reinforced fluid-impervious elastomer. In this respect, the particular manner in which the end tank sections 12 and the intermediate tank sections 13 are formed, thereby forming the complete outer tank section 11, is clearly set forth in my copending application, Ser. No. 478,738, now U.S. Pat. No. 3,919,030 filed June 12, 1974 and entitled "Elastic Storage Tank and Method of Making the Same". Since the method of forming the outer tank section 11 is the same as that disclosed in my copending application, the disclosure in my copending application Ser. No. 478,738 now U.S. Pat. No. 3,919,030 is incorporated by reference herein and is made a part hereof.

Therefore, each blank from which each end section 12 is formed is folded and joined together to thereby form each end tank section 12. In this respect, the arcuate corner portions of each end tank is formed by elongate arcuate inner (not shown) and outer attachment members 17 which are formed of a suitable elastomer, and provided with a suitable adhesive for application to the corner portions as set forth in my copending application. Since the inner and outer attachment members 17 are preformed to arcuate configuration, there is no inherent memory in these attachment members, thereby assuring that the corner portions will remain rounded or arcuate in configuration. The lapped construction of the corner portions, as well as the provision of inner and outer attachment members provides a very strong stress resistant structure.

The intermediate tank section 13 is formed from a single elongate, generally rectangular blank of the fiber-reinforced elastomer, the transverse edges of the blank being disposed in overlapped relation and secured together by a suitable adhesive and by seaing tapes 18 which overly and underly the lapped ends. When the intermediate tank section is formed, it presents continuous peripheral end edges at opposite ends thereof. The peripheral edge of each end tank section 12 is then disposed in overlapped relation with the peripheral end edges of the intermediate tank section 13 and are joined together in sealing relation thereto by a suitable adhesive and by suitable elongate sealing tapes 19 to seal the end sections to the intermediate sections.

Inlet or filler means are provided on the intermediate tank section and to this end the intermediate section is provided with a large opening 20 having a plurality of small apertures 21 formed therein, closely adjacent the edge defining the opening 20. An attachment ring 22 formed of a suitable metal is positioned against the interior surface of the intermediate section, the ring 22 having a plurality of threaded openings therein for accommodating bolts 23. The filler pipe 24 which is secured to a substantially flat mounting plate 25 is positioned against the exterior surface of the intermediate tank section 13. The mounting plate 25 has a plurality of spaced apart apertures 26 therein which accommodate the bolts 23 to thereby permit the mounting plate to be secured to the intermediate tank section. The filler pipe 24 is provided with a closure or valve 27.

The tank 10 also includes an envelope 28 which is positioned interiorly of the tank and which serves as a chemical barrier. The envelope 28 is formed of a film of chemically inert fluid impervious plastic material, such as polyethylene, mylar, but preferably polyamide. The envelope 28 corresponds generally in shape to the outer tank section 11, but is slightly larger in size than the outer tank section. The envelope 28 is formed from a tube whose end edges 29 are each sealed together so that the envelope defines upper and lower wall portions 30 and side wall portions 31. The upper wall portion of the envelope is provided with an opening 32 therein having an outturned collar 33 extending outwardly therefrom. The collar 33 is adapted to be positioned adjacent the exterior surface of the intermediate tank section in surrounding relation with respect to the opening 20 therein. An apertured annular gasket 35 is secured to the outturned collar 33, and the apertures 34 in the gasket and in the outturned collar are disposed in registering relation with respect to the apertures 21 in the intermediate tank section. The bolts 23 therefore extend through the gasket and the outturned collar when they are secured to the attachment ring 22.

The manner in which the tank 10 is assembled is important to the proper use of the tank. In this respect, the outer tank section will be completely assembled, as will the envelope 28. The inlet or filler means will not be attached to the outer tank section until the envelope is inserted into the inner tank section. In preparing the envelope for insertion into the outer tank section, one end portion of the envelope which has been designated by the reference numeral 1 is folded, starting with the outer end thereof with narrow transverse accordian pleats 36 to a point adjacent the opening 32 therein. The other end portion designated by the reference numeral 2 is then folded towards the middle thereof with accordian pleats 36 to a point closely adjacent the opening 32 therein. Then the envelope is folded on one longitudinal edge 3 thereof with longitudinally extending accordian pleats 37 to the midportion of the envelope, and finally, the envelope is folded from the longitudinal edge 4 thereof with longitudinally extending accordian pleats to the central portion thereof. While in this folded condition, the folded envelope will be subjected to a vacuum and will assume the folded position illustrated in FIG. 1.

Th envelope may then be inserted through the opening 20 in the intermediate tank section 13 to position the collar 32 and the gasket 35 exteriorly of the intermediate tank section. The filler means will be applied to the tank, but the bolts 23 will only be tightened to a hand tight condition to only loosely clamp the collar and gasket between the attachment ring and the plate 25. Thereafter, the tank 10 will be filled with a suitable liquid, preferably water, to cause the envelope to unfold and engage the inner surface of the outer tank member 11. Because of the unique manner in which the envelope is folded, it will be first unfolded transversely to engage the inner surface of the intermediate tank section and will thereafter unfold longitudinally to then fill and engage the end tank sections of the outer tank member. This is important in order to assure evacuation of air trapped between the envelope and the outer tank member. The air will be forced outwardly between the plate 25 and the collar and gasket attached to the envelope since the plate is only loosely attached at this time. After air has been evacuated from any space between the outer tank member and the envelope, the bolts 23 will then be tightened to form an air seal between the plate and the envelope. Thereafter, the water may be removed from the interior of the tank, and when this occurs, the envelope will adhere to the inner surface of the outer tank member because of a partial vacuum or negative pressure between the envelope and the outer tank member which occurs during the original filling operation. Since the envelope is slightly larger than the outer tank member 11, the inner tank member may be formed of a film material since it will not be subjected to any undue stresses, even when the tank 10 is filled with a liquid.

By using a chemically inert envelope, the tank 10 may be used to contain and store corrosive material such as the various herbicides and insecticides and the like. The chemical barrier characteristics of the envelope also permit the tank to be used to contain food stuffs, such as milk, syrup and the like since the chemically inert envelope made from polyamide, polyethylene, mylar or the like has been approved as a suitable container for such food materials. Through the use of the envelope, the need for scrubbing tanks when used with toxic corrosive material such as herbicides or insecticides is obviated. Thus it will be seen that I have provided a novel elastic storage tank which is highly effective as a means for storing various kinds of liquids, regardless of their chemical characteristics.

What is claimed is:

1. An elastic storage tank for fluid or fluid-like material comprising:

an outer tank member, including a pair of substantially identical end tank sections, each being formed from a single blank of a fiber-reinforced elastomer, each tank section including upper and lower wall portions, each section being defined by a pair of panels, formed by folding the blank along a longitudinal fold line, each tank section including side wall portions extending between and being joined with said upper and lower wall portions, said side wall portions being defined by elongate end panels of said blank which are formed by folding one of the upper or lower wall-defining panels along transverse lines, adjacent opposite ends of said last-mentioned wall-defining panels, each side wall portion having a triangular flap, the other of said upper and lower wall portions having a pair of generally triangular shaped flaps, each projecting therefrom and overlapping and being secured in sealing relation to one of said flaps on a side wall portion, said one upper or lower wall portion having arcuate edge portions, each arcuate edge portion located on the blank between a flap on a side wall portion and a flap on the other upper or lower wall portion, a pair of formed arcuate attachment members, each being secured in sealing relation to the lapped flaps on the side wall portion and on the other of said upper or lower wall portions, and to an arcuate edge portion of said one of the upper or lower wall portions, an intermediate tank section formed from a single blank of fiber-reinforced elastomer, said intermediate tank section having peripheral edges at opposite ends thereof, said end tank sections having a peripheral edge at one end thereof engaging and being secured to the peripheral edge of said intermediate tank section is sealing relation therewith, said intermediate section having an opening therein, a flexible envelope formed of a film of chemically inert fluid impervious plastic material, said envelope having a shape corresponding to the outer tank member and being slightly larger in size than said outer tank member, said envelope having an opening therein registering with the opening in said inner tank member, said envelope having an outturned collar adjacent said opening extending exteriorly of said outer tank member adjacent the opening therein, filler means including a filler pipe having an apertured mounting plate secured to the lower end thereof, means securing said plate to the outer tank member to clamp the collar of said envelope in sealed relation therebetween, and closure means for closing said filler pipe.

2. The tank is defined in claim 1 wherein said envelope is formed from a fluid impervious plastic material selected from the group including polyethylene, mylar and polyamide.

3. The tank as defined in claim 2, wherein said envelope is formed from polyamide.

4. The tank as defined in claim 1 and a compressible gasket interposed between the collar of said envelope and said mounting plate of said filler means.

* * * * *